US010233067B2

(12) United States Patent
Fogg et al.

(10) Patent No.: US 10,233,067 B2
(45) Date of Patent: Mar. 19, 2019

(54) FILLER VALVE HAVING A DIAPHRAGM, A DIAPHRAGM FOR A FILLER, AND METHOD OF MANUFACTURING

(71) Applicant: Fogg Filler Company, Holland, MI (US)

(72) Inventors: Michael Fogg, Holland, MI (US); Larry Rillema, Zeeland, MI (US); Lon Eding, Zeeland, MI (US)

(73) Assignee: Fogg Filler Company, Holland, MI (US)

( * ) Notice: Subject to any disclaimer, the term of this patent is extended or adjusted under 35 U.S.C. 154(b) by 98 days.

(21) Appl. No.: 15/400,049

(22) Filed: Jan. 6, 2017

(65) Prior Publication Data

US 2018/0194606 A1 Jul. 12, 2018

(51) Int. Cl.

| | |
|---|---|
| ***B67C 3/28*** | (2006.01) |
| ***B65B 3/04*** | (2006.01) |
| *B67C 3/00* | (2006.01) |

(52) U.S. Cl.

CPC ..... *B67C 3/28* (2013.01); *B65B 3/04* (2013.01); *B67C 3/001* (2013.01)

(58) Field of Classification Search

CPC ..... B67C 3/28; B67C 3/001; B65B 3/04

See application file for complete search history.

(56) References Cited

U.S. PATENT DOCUMENTS

| | | | | | |
|---|---|---|---|---|---|
| 2,499,149 | A * | 2/1950 | Lippold | B67C 3/2637 | 137/588 |
| 2,711,279 | A * | 6/1955 | Day | B67C 3/16 | 141/117 |
| 2,716,517 | A * | 8/1955 | Tollberg | B67C 3/16 | 141/117 |
| 3,416,577 | A * | 12/1968 | Franz | B67C 3/2637 | 141/117 |
| 3,799,222 | A * | 3/1974 | Franz | B67C 3/16 | 141/291 |
| 3,848,645 | A * | 11/1974 | Franz | B67C 3/16 | 141/117 |
| 3,871,425 | A * | 3/1975 | Fee | B67C 3/26 | 141/117 |
| 4,141,394 | A * | 2/1979 | Lassman | B67D 7/54 | 141/284 |

(Continued)

*Primary Examiner* — Nicolas A Arnett

(74) *Attorney, Agent, or Firm* — The Watson IP Group, PLC; Jovan N. Jovanovic; Vladan M. Vasiljevic

(57) ABSTRACT

A diaphragm assembly for use with a filler valve including a central bellows, an upper mating structure and a lower mating structure. The central bellows has a first portion and a second portion. The upper mating structure matingly engageable in substantially sealed engagement with an outer surface of a valve body. The lower mating structure is positioned at the first end of the second portion and has an inner ring member, a first encasing structure and an outer encasing structure. The inner ring member comprises a rigid material. The first encasing structure encases the inner ring member and includes an inner annular sealing surface structurally configured to slidably engage the outer surface of the valve body. The outer encasing structure encasing at least a portion of the first encasing structure. The combination of the first encasing structure and the outer encasing structure completely encapsulate the inner ring member.

24 Claims, 8 Drawing Sheets

(56) References Cited

U.S. PATENT DOCUMENTS

| | | | | |
|---|---|---|---|---|
| 5,083,593 | A * | 1/1992 | Fogg | B65B 39/004 141/275 |
| 5,178,304 | A * | 1/1993 | Torterotot | B65B 3/32 222/333 |
| 6,253,811 | B1 * | 7/2001 | Slagh | B65B 39/004 141/291 |
| 6,786,248 | B2 * | 9/2004 | Johnson | B67C 3/28 141/146 |
| 9,073,740 | B2 * | 7/2015 | Beyers | B67C 3/2608 |

* cited by examiner

FILLER VALVE HAVING A DIAPHRAGM, A DIAPHRAGM FOR A FILLER, AND METHOD OF MANUFACTURING

CROSS-REFERENCE TO RELATED APPLICATION

N/A

BACKGROUND OF THE DISCLOSURE

1. Field of the Disclosure

The disclosure relates in general to filling equipment, typically suited for the filling of rigid packaging, such as bottles and the like, and more particularly, to a filler valve having a diaphragm, as well as the diaphragm itself, and a method of manufacturing the diaphragm.

2. Background Art

The use of filling equipment is known in the art. While the filling of certain flowable materials (which may include cleaning preparations, syrups, drinks, juices, oils, edible liquids, purees, and other edible and non-edible materials) are not sensitive to microbes and microbial growth, other flowable materials, such as edible produces, and especially such products that are of lower acidity (often referred to as low acid or the like), tend to be very sensitive to microbes.

Therefore, the filling equipment in such sensitive applications is cleaned and disinfected under strict protocols and conditions. Even where such protocols and conditions are followed, compromises to the equipment and damage to the equipment, which may be caused by wear or mechanical fault, may result in the increase in microbial growth. This can be especially problematic where no preservatives are utilized.

One such area of damage has been in the area of flexible structures and seals. Many such seals require a metal frame or member to provide the necessary rigidity to the overall structure, as well as a flexible rubber, silicone or other polymer based material for sealing flexibility. For components that are in virtually constant motion, it has been found that the flexible material separates from the underlying metal frame, and forms a pocket where microbes can thrive. Problematically, such pockets are isolated and often cannot be seen by operators, and often cannot be adequately reached during cleaning.

SUMMARY OF THE DISCLOSURE

In one aspect of the disclosure, the disclosure is directed a filler valve having a valve body, a vent tube, and a diaphragm assembly. The valve body has a proximal end and a distal end. The valve body also has an outer surface and an inner bore having a lower opening. The vent tube assembly has an upper vent structure and a closure member. The valve body is movable relative to the vent tube so as to seal the lower opening of the valve body. The diaphragm assembly has a central bellows, an upper mating structure and a lower mating structure. The central bellows has a first portion and a second portion coupled to the first portion. The upper mating structure is positioned at a first end of the first portion. The upper mating structure is matingly engageable in substantially sealed engagement with the outer surface of the valve body. The lower mating structure is positioned at the first end of the second portion, and has an inner ring member, a first encasing structure and an outer encasing structure. The inner ring member comprises a rigid material. The first encasing structure encases the inner ring member and includes an inner annular sealing surface structurally configured to slidably engage the outer surface of the valve body. The outer encasing structure encases at least a portion of the first encasing structure, wherein the combination of the first encasing structure and the outer encasing structure completely encapsulate the inner ring member.

In some configurations, the inner ring member further includes an upper surface, a lower surface, an inner rim surface and an outer rim surface.

In some configurations, a plurality of openings extend through the inner ring member, in a spaced apart configuration between the upper and lower surfaces thereof.

In some configurations, the first encasing structure further includes a plurality of access openings substantially corresponding to the plurality of openings of the inner ring member.

In some configurations, the outer encasing structure includes a plurality of plug protrusions extending into the plurality of access openings, to seal the same.

In some configurations, the first encasing structure further includes an outer annular wing extending into the second portion of the central bellows.

In some configurations, the outer annular wing comprises an upwardly and outwardly tapering structure.

In some configurations, an inner surface of the second portion includes a plurality of spaced apart ribs positioned thereon between a first end and second end thereof.

In some configurations, a portion of the outer encasing structure is structurally configured to slidably engage the outer surface of the valve body.

In some configurations, the first portion and the second portion each comprise a frustoconical configuration wherein a second end of each of the first portion and the second portion meet at an apex rim.

In some configurations, the outer encasing structure, the first portion and the second portion comprise a single monolithic material, overmolding at least a portion of the first encasings structure, which extends about the inner ring member, thereby fully encasing the same.

In some configurations, the upper mating structure defines an inner ledge at a first end thereof.

In another aspect of the disclosure, the disclosure is directed to a diaphragm assembly for use with a filler valve. Such a diaphragm includes a central bellows, an upper mating structure and a lower mating structure. The central bellows has a first portion and a second portion coupled to the first portion. The upper mating structure is positioned at a first end of the first portion. The upper mating structure matingly engageable in substantially sealed engagement with an outer surface of a valve body. The lower mating structure is positioned at the first end of the second portion. The lower mating structure has an inner ring member, a first encasing structure and an outer encasing structure. The inner ring member comprises a rigid material. The first encasing structure encases the inner ring member and includes an inner annular sealing surface structurally configured to slidably engage the outer surface of the valve body. The outer encasing structure encasing at least a portion of the first encasing structure. The combination of the first encasing structure and the outer encasing structure completely encapsulate the inner ring member.

In some configurations, the inner ring member further includes an upper surface, a lower surface, an inner rim surface and an outer rim surface.

In some configurations, a plurality of openings extend through the inner ring member, in a spaced apart configuration between the upper and lower surfaces thereof.

In some configurations, the first encasing structure further includes a plurality of access openings substantially corresponding to the plurality of openings of the inner ring member.

In some configurations, the outer encasing structure includes a plurality of plug protrusions extending into the plurality of access openings, to seal the same.

In some configurations, the first encasing structure further includes an outer annular wing extending into the second portion of the central bellows.

In some configurations, the outer annular wing comprises an upwardly and outwardly tapering structure.

In some configurations, an inner surface of the second portion includes a plurality of spaced apart ribs positioned thereon between a first end and second end thereof.

In some configurations, the first portion and the second portion each comprise a frustoconical configuration wherein a second end of each of the first portion and the second portion meet at an apex rim.

In yet another aspect of the disclosure, the disclosure is directed to a method of manufacturing a diaphragm assembly for use with a filler valve. The method comprises the steps of: providing an inner ring member comprising a rigid material; molding a first encasing structure to encase the inner ring member, while retaining the inner ring member; molding an outer encasing structure encasing at least a portion of the first encasing structure, wherein the combination of the first encasing structure and the outer encasing structure completely encapsulate the inner ring member, so as to collectively form a lower mating structure, the lower mating structure structurally configured to slidably engage with an outer surface of a valve body; molding a central bellows having a first portion and a second portion, with the second portion forming the outer casing structure; and molding an upper mating structure at a first end of the first portion, the upper structure structurally configured to matingly engage with the outer surface of the valve body.

In some configurations, the step of molding an outer encasing structure and the step of molding a central bellows and the step of molding an upper mating structure comprise a single step forming a single monolithic member having the outer casing structure, the central bellows and the upper mating structure.

In some configurations, the inner ring member comprises a metal member, the first encasing structure comprises a silicone material and the outer encasing structure comprises a silicone material.

BRIEF DESCRIPTION OF THE DRAWINGS

The disclosure will now be described with reference to the drawings wherein.

DETAILED DESCRIPTION OF THE DISCLOSURE

Figure 1:
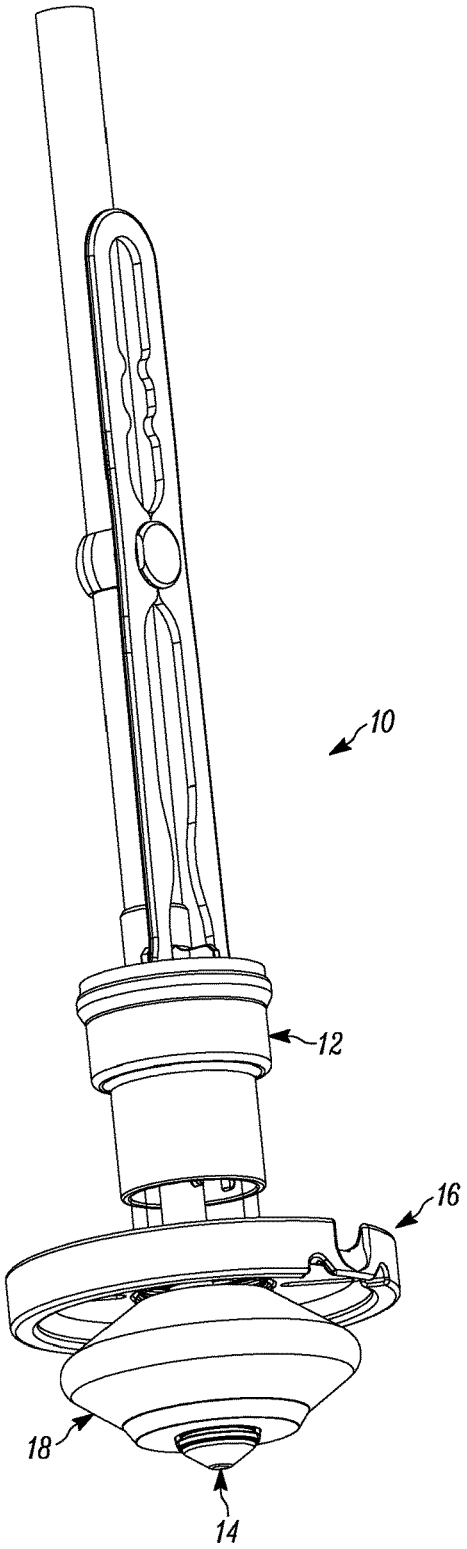
FIG. 1 of the drawings is a perspective view of the filler valve of the present disclosure, showing, in particular, the diaphragm of the present disclosure in an operational configuration.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the disclosure is directed to filler valve having a diaphragm, with the filler valve being shown generally at 10. The disclosure is likewise directed to the diaphragm, as well as to a method of manufacturing a diaphragm for the filler valve. Such filler valves are found on fillers such as fillers sold under the model numbers F9, F8, F6.3, F5, F4, among others of Fogg Filler Company of Holland, Mich. Of course, the disclosure is not limited to such fillers and can be utilized with other fillers from other manufacturers. The disclosed fillers are for exemplary purposes. It will also be understood that while the fillers described above are used in association with multiple filler heads and filler valves, the filler valve may be utilized with a single head filler that may be a manual or non-manual filler.

Figure 2:
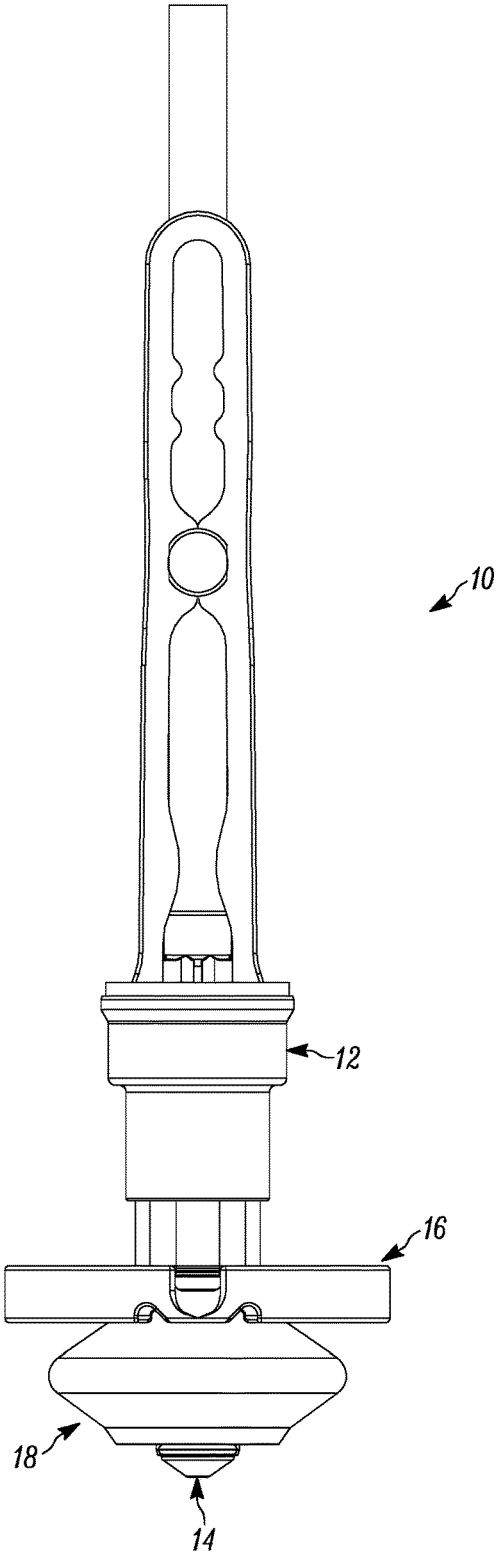
FIG. 2 of the drawing is a front plan view of the filler valve of the present disclosure, showing, in particular, the diaphragm of the present disclosure in an operational configuration.
Figure 3:
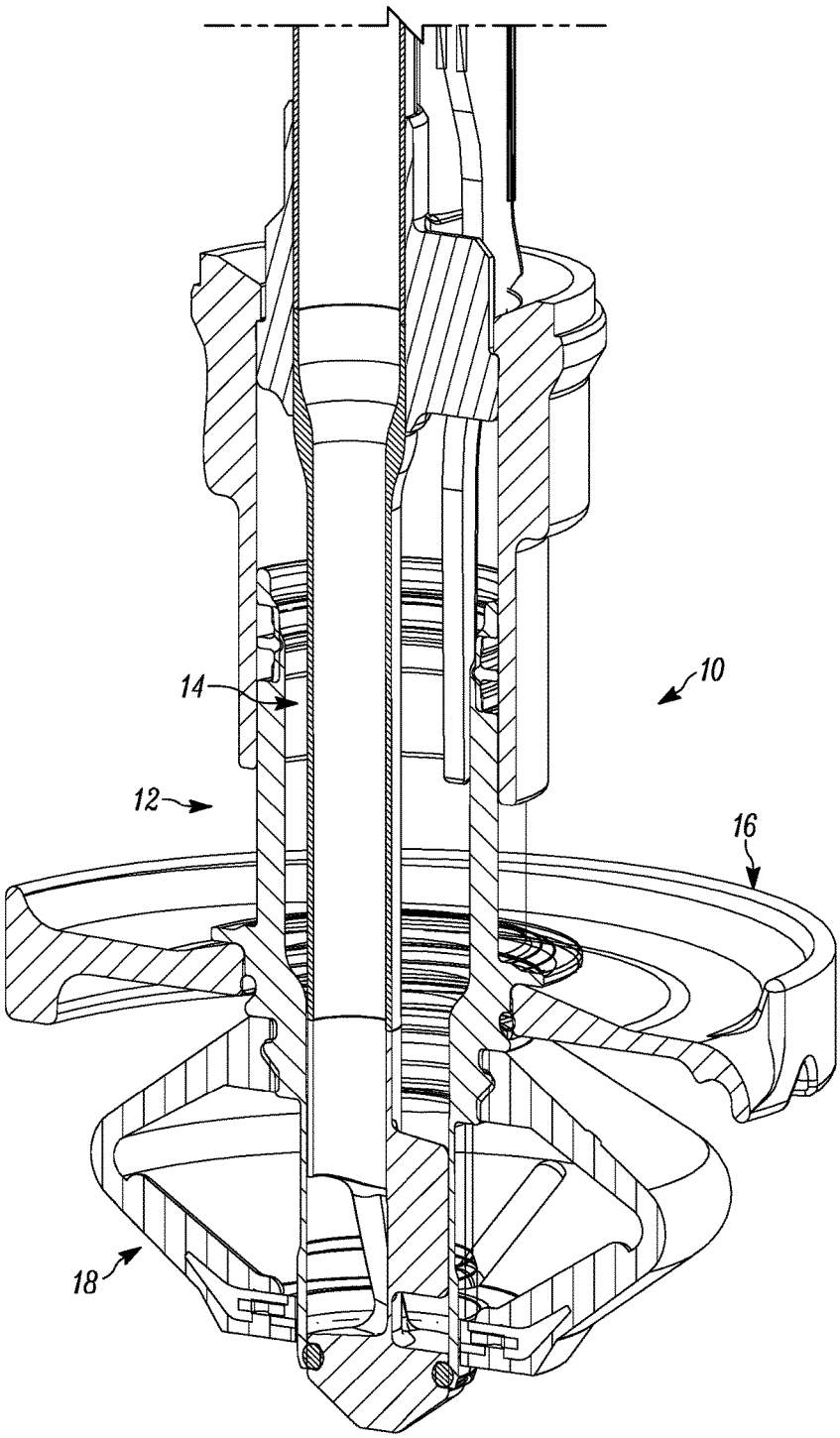
FIG. 3 of the drawings is a cross-sectional perspective view of the filler valve of the present disclosure, showing, in particular, the diaphragm of the present disclosure and manner in which the diaphragm is coupled to and engages the filler valve, and in particular, the diaphragm seal interface and the diaphragm traverse surface.

The filler valve 10 is shown in FIGS. 1 through 3 as comprising valve body 12, vent tube assembly 14, upper plate 16 and diaphragm assembly 18. It will be understood that portions of the filler valve body 12 have been removed for pictorial clarity and that additional structures are present to couple the filler valve to a bowl or to other portions of the filler. In the configuration shown, the valve body 12 extends from proximal end 20 (which interfaces with a bottle to be filled) to distal end 21. The valve body includes outer surface 22 and inner bore 23. The outer surface 25, among other structures, includes diaphragm traverse surface 25, upper plate interface 26 and diaphragm seal interface 27. The diaphragm traverse surface 25 comprises the surface across which the lower mating structure 74 of the diaphragm traverses as that portion of the valve body is inserted into the bottle for filling. It will also be understood that at least a portion of that surface enters into the bottle that is to be filled.

The upper plate interface 26 includes upper plate flange 30, upper plate seal surface 32 and upper plate seal channel 33. As will be explained below, the upper plate is coupled to the valve body in such an orientation. The upper plate forms the upper surface upon which the diaphragm contacts when compressed. As such, the upper plate interface 26 provides a solid structure upon which the upper plate can be mounted and sealingly engaged. The upper plate flange 30 extends axially outwardly from the outer surface 22 so as to limit upward movement of the upper plate. The upper plate seal surface and seal channel sealingly engage the upper plate to the valve body.

The diaphragm seal interface 27 includes upper flange 34, upper seal surface 36 and upper seal tab 37. The diaphragm seal interface 27 is configured to sealingly engage the upper mating structure 72 of the diaphragm assembly and is configured to preclude disengagement and both upward and downward movement of the upper mating structure 72 of the diaphragm assembly 18.

The inner bore 23 of the valve body 12 includes inner surface 28. It will be understood that the inner bore 23 is in fluid communication with a supply of flowable material that is to be filled into the bottle to be filled. Additionally, the inner bore 23 is in communication with a venting tube that can direct vented gas from the bottle out of the bottle so that the same can be replaced with the flowable material.

The vent tube assembly 14 is shown as comprising upper vent structure 40 and closure member 42. The upper vent structure 40 includes vent tube bore 43 and opening 44. The closure member 42 includes outer perimeter 45 and sealing ring 46. The outer perimeter and the sealing ring cooperate to seal the lower opening 29 of the inner bore 23 of the valve body 12. It will be understood that the vent tube assembly 14 can be directed downwardly so as to direct the closure member away from the lower opening 29 of the inner bore 23, thereby allowing fluid to flow from the filler valve into the bottle, and also to allow air or other gasses from within the bottle to exit through the vent tube. The vent tube assembly can then be raised The upper plate 16 includes top surface 50, bottom surface 52, inner edge 53 and outer rim 54. As explained above, the upper plate provides a contact surface for the first portion 80 of the diaphragm 18 when the valve body is inserted into the bottle to be filled and the lower mating structure 74 diaphragm is raised relative to the valve body. In particular, the diaphragm will contact the bottom surface 52 thereof. The bottom surface 52 includes a plurality of annular ribs 56 so as to maintain spacing between the diaphragm and the remainder of the bottom surface, and to preclude a vacuum effect wherein air is trapped therebetween (i.e., a suction effect). The top surface 50 about the inner edge 53 abuts the upper plate flange 30 precluding further upward movement of the upper plate.

The inner edge 53 defines a central bore 60 which extends annularly about the valve body proximate the upper plate interface 26. The outer rim 54 includes lower portion 62, upper portion 64, lower drainage channel 66 and upper drainage channel 67. The lower portion defines, in part, the bottom surface 52 with the upper portion defining, in part, the top surface 50. The upper and lower drainage channels 66, 67 provide a path for any fluid that has gathered on either one of the top and bottom surfaces of the upper plate 16.

Figure 4:
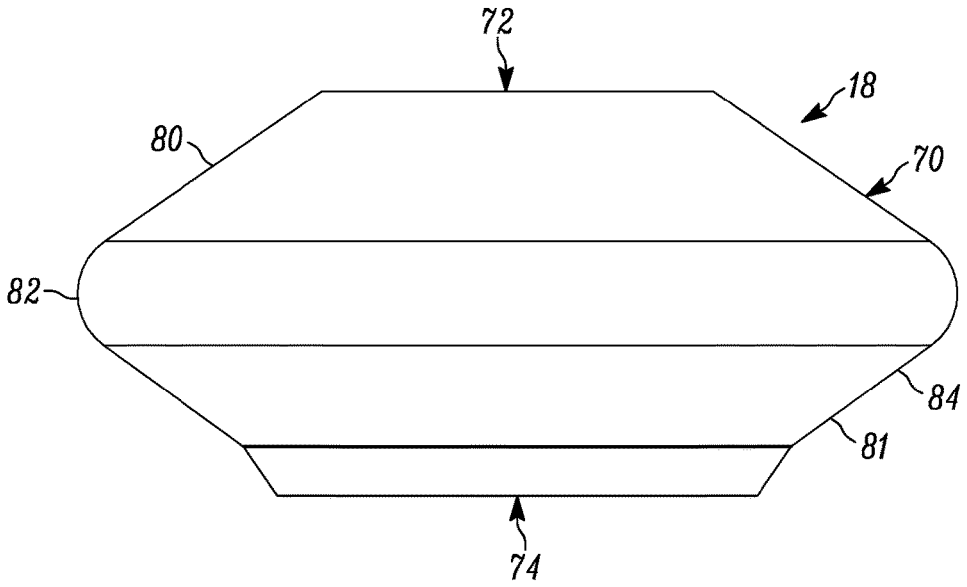
FIG. 4 of the drawings is a side elevational view of the diaphragm of the present disclosure.
Figure 5:
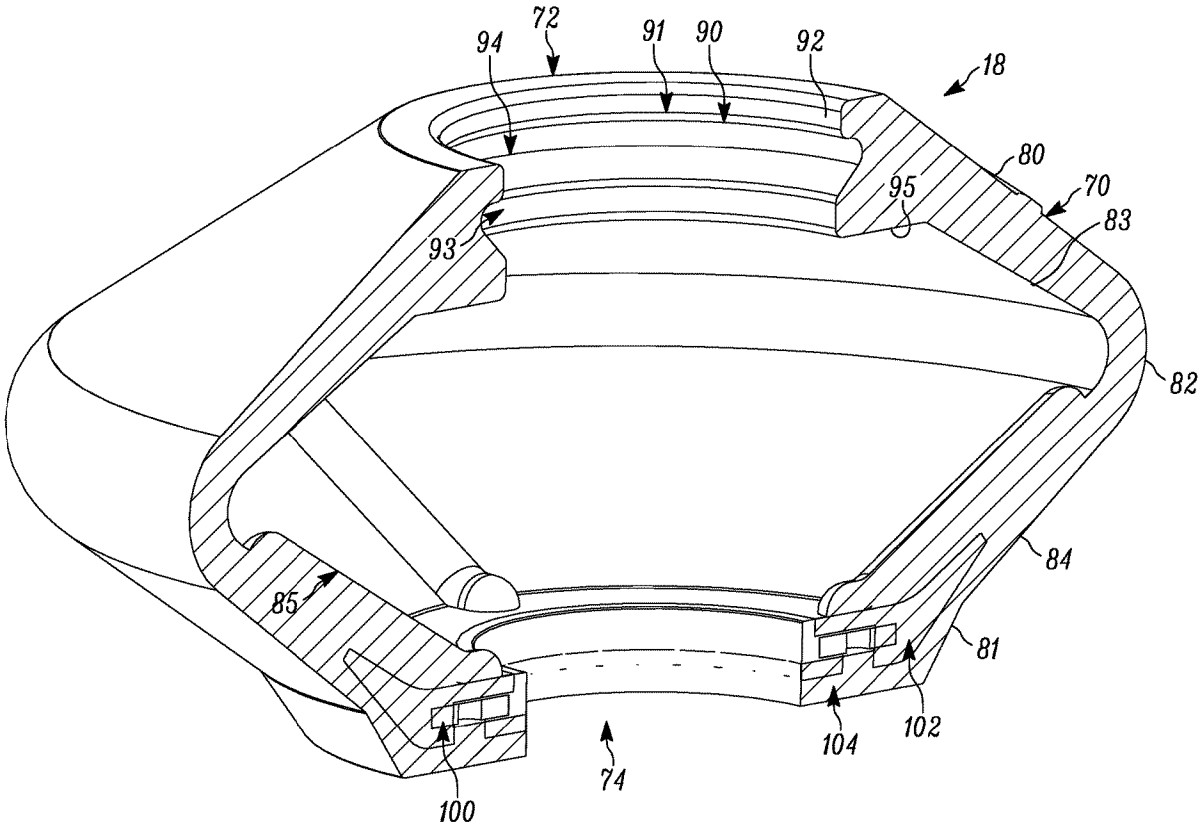
FIG. 5 of the drawings is a cross-sectional perspective view of the diaphragm of the present disclosure.
Figure 6:
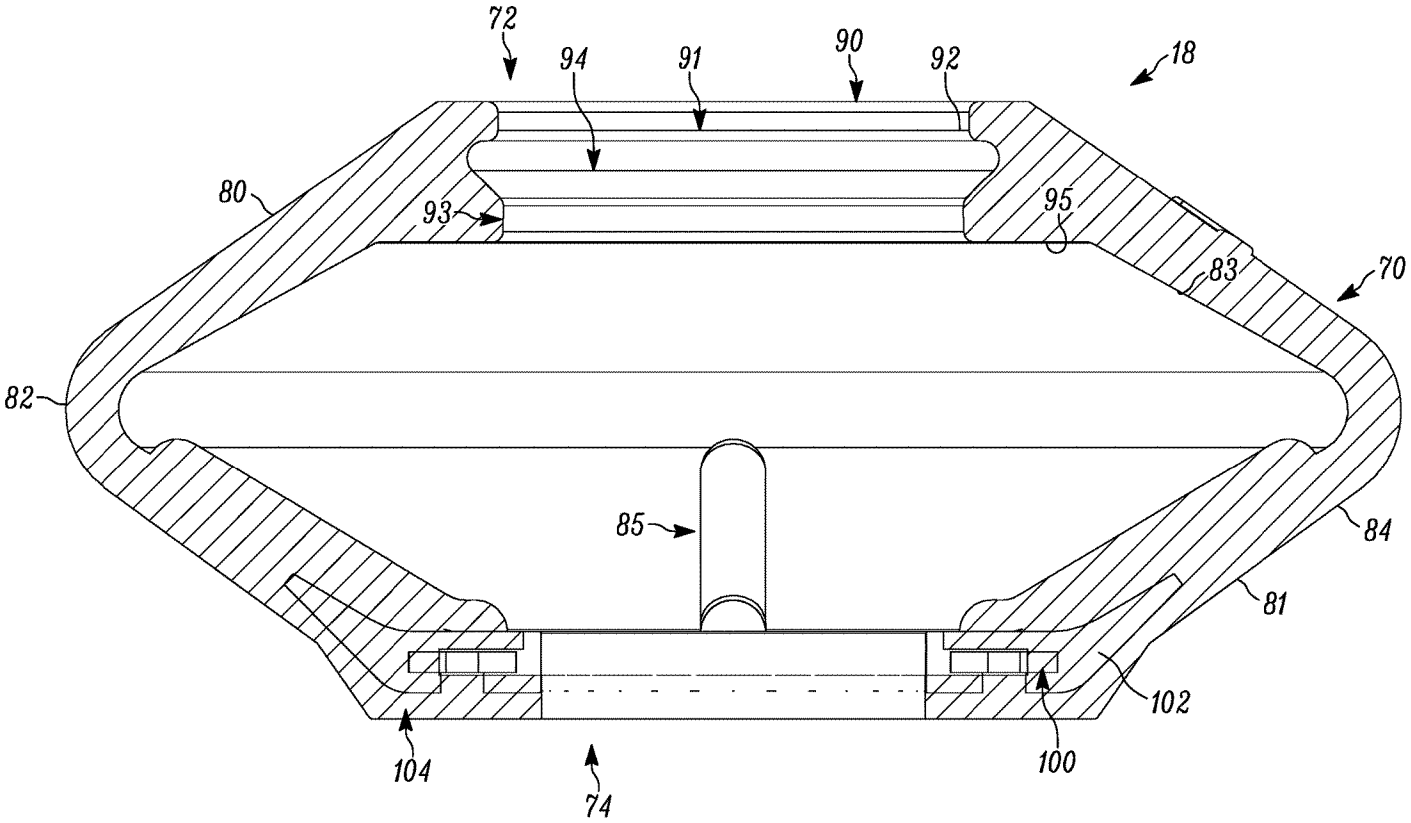
FIG. 6 of the drawings is a cross-sectional view of the diaphragm of the present disclosure.
Figure 7:
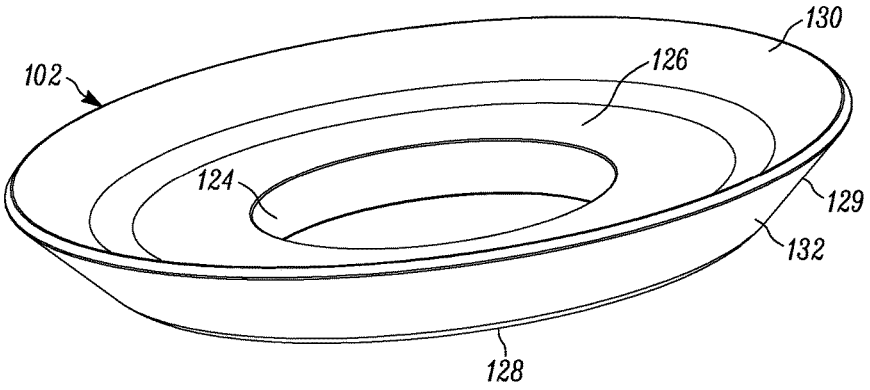
FIG. 7 of the drawings is a perspective view of the first encasing structure of the diaphragm of the present disclosure.
Figure 8:
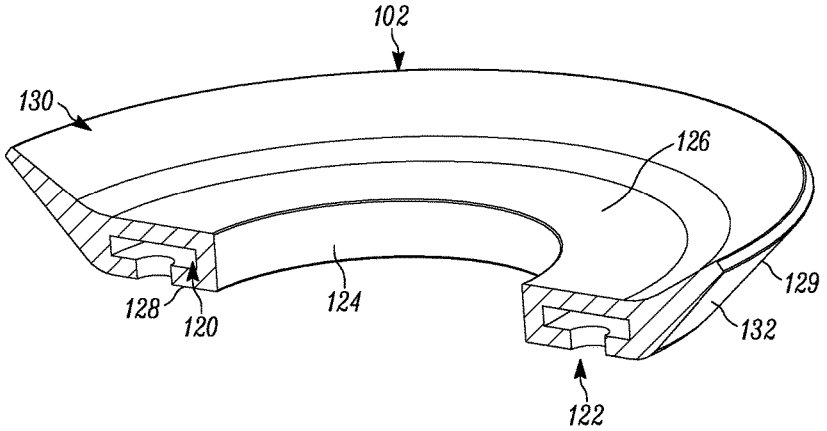
FIG. 8 of the drawings is a cross-sectional view of the first encasing structure of the diaphragm of the present disclosure.
Figure 9:
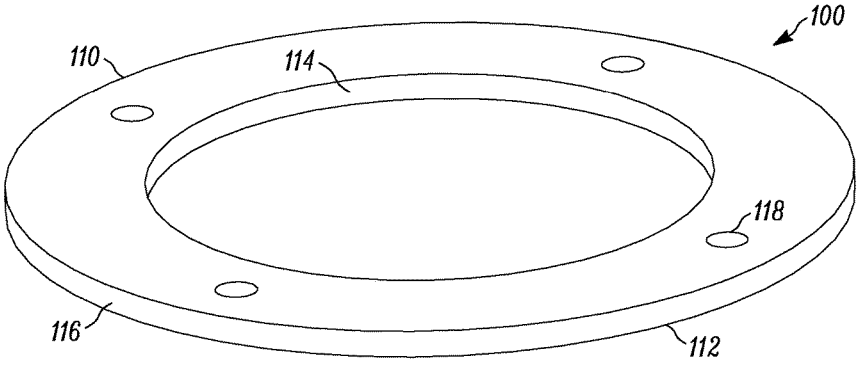
FIG. 9 of the drawings is a perspective view of the inner ring member of the diaphragm of the present disclosure.

The diaphragm assembly 18 is shown in FIGS. 4 through 6 as comprising central bellows 70, upper mating structure 72 and lower mating structure 74. The central bellows comprises a first portion 80, second portion 81, apex rim 82, which are defined by inner surface 83 and outer surface 84. The central bellows 70 comprises a molded member, preferably a silicone based material having the desired flexibility. For example, the central bellows 70 may comprise a silicone having a shore A hardness of approximately 20 through 70, although other hardness is contemplated.

In the configuration shown, a single bellows structure is shown, wherein the bellows is defined by an outwardly proceeding first portion 80 and an inwardly proceeding second portion 81, both of which are frustoconical structures that meet at the apex rim 82. The first and second portions are largely dimensionally mirror images of each other. The first portion 80 extends from first end 77 to second end 78 (or from the upper mating structure to the apex rim). The second portion extends from first end 87 to second end 88 (or from the lower mating structure to the apex rim). The inner surface of the second portion 80 further includes rib members, such as rib member 85 which is configured to provide rigidity to the structure as well as to maintain separation between the inner surfaces of the first portion and the second portion, so as to preclude a suction effect therebetween, which would preclude separation thereof.

It will be understood that while a single apex is shown, multiple apexes are contemplated, wherein between the first and second portions, another pair of portions are positioned so as to define a pair of spaced apart apex rims. Additionally, it will be understood that while the first and second portion are shown to be mirror images of each other, other configurations are contemplated, including configurations wherein the shapes are different and wherein the bellows lacks a defined apex rim. For example, the structure may comprise a outwardly convex structure which has any number of different shapes, wherein portions overlie each other when compressed together, so as to overlie each other.

The upper mating structure defining an inner bore 90 and a mating surface 91. The inner bore 90 is defined at the first end of the first portion 80 of the central bellows. In the configuration shown, the upper mating structure is integrally formed with the central bellows 70 in a monolithic configuration. It is contemplated that such a structure may be co-molded, adhered, or otherwise coupled and sealed to the central bellows. In the construction shown, the upper mating structure forms an inner ledge 95 at the first end of the first portion 80 of the central bellows 70.

The mating surface 91 includes upper portion 92, lower portion 93 and central channel 94. The upper portion 92 interfaces with the upper flange 34, with the lower portion 93 interfacing with the upper seal surface 36. Finally, the upper seal tab 37 of the valve body extends into the central channel 94 to sealingly engage the upper mating structure of the diaphragm assembly with the diaphragm seal interface of the valve body. Of course, it is contemplated that other structures may be utilized for each of the diaphragm seal interface and the upper mating structure to essentially couple the two structures to each other in sealed engagement.

The lower mating structure 74 includes inner ring member 100, first encasing structure 102 and outer encasing structure 104. As will be explained below, the inner ring member 100 is substantially encapsulated within the first encasing structure 102 which is then encapsulated within the outer encasing structure 104. In the configuration shown, the outer encasing structure 104 is integrally formed with the central bellows 70.

The inner ring member 100 comprises rigid member (relative to the central bellows) and in the configuration shown includes a flattened washer type ring member, having a substantially rectangular cross-sectional configuration defining an upper surface 110, lower surface 112, inner rim surface 114, outer rim surface 116. In the configuration shown, the width of the ring member is two to five times greater than the thickness of the ring member (that is the height of the inner and outer rim surfaces).

A plurality of openings, such as opening 118 (for purposes of retaining, grasping, and/or locating) extend through from the lower surface 112 to the upper surface 110. In the configuration shown, there are four spaced apart openings about the inner ring member, spaced approximately 90° apart from each other. In the configuration shown, the inner ring member comprises a metal member, such as a steel or stainless steel member. In other configurations, the inner ring member may comprise a composite material or a rigid polymer member.

The first encasing structure 102 is shown as comprising central void 120, access openings, such as access openings 122, inner annular sealing surface 124, upper surface 126, lower surface 128 and outer annular wing. The first encasing structure 102 encapsulates the inner ring member, such that the inner ring member is placed within the central void 120. Additionally, the access openings 122 correspond to the openings 118. The inner annular sealing surface 124 defines, in part, the bore of the lower mating structure which is configured to slidably engage the diaphragm traverse surface 25 of the outer surface 22 of the valve body 12. The first encasing structure comprises a silicone base polymer material, for example, a silicone having a shore A hardness of between 20 and 70, while other materials and hardnesses are contemplated for use.

The upper and lower surfaces are substantially parallel to each other and perpendicular to the inner annular sealing surface. The outer annular wing 129 extends annular outwardly and upwardly within the second portion of the central bellows. The annular wing includes upper surface 130 and lower surface 132. The annular wing tapers while extending away from the inner ring member.

The outer encasing structure (which is integrally formed with the second portion of the central bellows and in the configuration shown, the central bellows) includes channel 134 which is structurally configured to receive the first encasing structure wherein a portion of the upper surface 126 and a portion of the inner annular sealing surface 124 are exposed. As such, the channel substantially matches the shape thereof. The channel therefore includes upper portion 135 (which defines the lower, ledge-like, surface at the first end 87 of the second portion) and lower portion 136. Inner sealing surface 138 extends proximate the inner annular sealing surface 124 and is substantially co axial therewith so that this surface engages the diaphragm traverse surface 25 along with the inner annular sealing surface 124. A plurality of plug protrusions, such as plug protrusions 139 extend into at least the access openings 122, and, in some configurations, into the openings 118. In the configuration shown, the rib members 85 extend onto the upper portion 135.

To manufacture the diaphragm assembly, the inner ring member is first provided and located within a mold by way of the dimensions thereof and the openings 118. Next, the first encasing structure 102 is molded over the inner ring member. Due to the use of the openings 118 during formation of the first encasing structure, the first encasing structure likewise includes a plurality of corresponding access openings 122. Once these are formed, the combined first encasing structure and the inner ring member are placed into a mold that forms the outer encasing structure along with the remainder of the central bellows and the upper mating structure, all of which comprise an integrally molded member in the configuration shown.

Once fully formed, the diaphragm assembly can be coupled to a filler valve. In particular, the diaphragm assembly can be slid over the distal end 21. Once slid over the distal end, the upper mating structure 72 is extended over the diaphragm seal interface 27 so that the upper seal tab 37 is directed into the central channel 94 placing the upper portion 92 proximate the upper flange, and the lower portion 93 over the upper seal surface 36. Due to the sizing, the upper mating structure is stretched to extend over the diaphragm seal interface so that the upper mating structure is pressed against the diaphragm seal interface and biased inwardly to effectuate a seal, preferably without additional clamps, ties, fasteners and the like.

Advantageously, such a structure encapsulates the inner ring member within the first encasing structure which is formed from a polymer material, such as a silicone material, that is compatible with the material from which the outer encasing structure and the central bellows if formed. As a result, the outer encasing structure is coupled, preferably only to the first encasing structure, thereby encapsulating the inner ring member, and precluding the separation of the inner ring member from the silicone, wherein the same is exposed to the outside. It has been found that where silicone or other polymers are mated to a metal or similar ring member, the adhesion over time is reduced and separation initiates. In turn, microbes can gather and grow within the space that has opened due to separation. Such areas are difficult to clean and disinfect. This can become a large problem as the diaphragm assembly is intimately associated with both the flowable material and also with the rims of the bottles. Microbes forming a foothold in such proximity to both the flowable material and can be very problematic.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A filler valve comprising:

a valve body having a proximal end and a distal end, the valve body having an outer surface and an inner bore having a lower opening;

a vent tube assembly having an upper vent structure and a closure member, the valve body movable relative to the vent tube so as to seal the lower opening of the valve body; and a diaphragm assembly having:

a central bellows, the central bellows having a first portion and a second portion coupled to the first portion;

an upper mating structure positioned at a first end of the first portion, the upper mating structure matingly engageable in substantially sealed engagement with the outer surface of the valve body; and a lower mating structure positioned at the first end of the second portion, the lower mating structure having:

an inner ring member comprising a rigid material;

a first encasing structure encasing the inner ring member, the first encasing structure including an inner annular sealing surface structurally configured to slidably engage the outer surface of the valve body; and an outer encasing structure encasing at least a portion of the first encasing structure, wherein the combination of the first encasing structure and the outer encasing structure completely encapsulate the inner ring member.

2. The filler valve of claim 1 wherein the inner ring member further includes an upper surface, a lower surface, an inner rim surface and an outer rim surface.

3. The filler valve of claim 2 wherein a plurality of openings extend through the inner ring member, in a spaced apart configuration between the upper and lower surfaces thereof.

4. The filler valve of claim 3 wherein the first encasing structure further includes a plurality of access openings substantially corresponding to the plurality of openings of the inner ring member.

5. The filler valve of claim 4 wherein the outer encasing structure includes a plurality of plug protrusions extending into the plurality of access openings, to seal the same.

6. The filler valve of claim 1 wherein the first encasing structure further includes an outer annular wing extending into the second portion of the central bellows.

7. The filler valve of claim 6 wherein the outer annular wing comprises an upwardly and outwardly tapering structure.

8. The filler valve of claim 1 wherein an inner surface of the second portion includes a plurality of spaced apart ribs positioned thereon between a first end and second end thereof.

9. The filler valve of claim 1 wherein a portion of the outer encasing structure is structurally configured to slidably engage the outer surface of the valve body.

10. The filler valve of claim 1 wherein the first portion and the second portion each comprise a frustoconical configuration wherein a second end of each of the first portion and the second portion meet at an apex rim.

11. The filler valve of claim 1 wherein the outer encasing structure, the first portion and the second portion comprise a single monolithic material, overmolding at least a portion of the first encasings structure, which extends about the inner ring member, thereby fully encasing the same.

12. The filler valve of claim 1 wherein the upper mating structure defines an inner ledge at a first end thereof.

13. A diaphragm assembly for use with a filler valve, the diaphragm assembly comprising:

a central bellows, the central bellows having a first portion and a second portion coupled to the first portion;

an upper mating structure positioned at a first end of the first portion, the upper mating structure matingly engageable in substantially sealed engagement with an outer surface of a valve body; and a lower mating structure positioned at the first end of the second portion, the lower mating structure having:

an inner ring member comprising a rigid material;

a first encasing structure encasing the inner ring member, the first encasing structure including an inner annular sealing surface structurally configured to slidably engage the outer surface of the valve body; and an outer encasing structure encasing at least a portion of the first encasing structure, wherein the combination of the first encasing structure and the outer encasing structure completely encapsulate the inner ring member.

14. The diaphragm of claim 13 wherein the inner ring member further includes an upper surface, a lower surface, an inner rim surface and an outer rim surface.

15. The diaphragm of claim 14 wherein a plurality of openings extend through the inner ring member, in a spaced apart configuration between the upper and lower surfaces thereof.

16. The diaphragm of claim 15 wherein the first encasing structure further includes a plurality of access openings substantially corresponding to the plurality of openings of the inner ring member.

17. The diaphragm of claim 16 wherein the outer encasing structure includes a plurality of plug protrusions extending into the plurality of access openings, to seal the same.

18. The diaphragm of claim 13 wherein the first encasing structure further includes an outer annular wing extending into the second portion of the central bellows.

19. The diaphragm of claim 18 wherein the outer annular wing comprises an upwardly and outwardly tapering structure.

20. The diaphragm of claim 13 wherein an inner surface of the second portion includes a plurality of spaced apart ribs positioned thereon between a first end and second end thereof.

21. The diaphragm of claim 13 wherein the first portion and the second portion each comprise a frustoconical configuration wherein a second end of each of the first portion and the second portion meet at an apex rim.

22. A method of manufacturing a diaphragm assembly for use with a filler valve, comprising the steps of:

providing an inner ring member comprising a rigid material;

molding a first encasing structure to encase the inner ring member, while retaining the inner ring member;

molding an outer encasing structure encasing at least a portion of the first encasing structure, wherein the combination of the first encasing structure and the outer encasing structure completely encapsulate the inner ring member, so as to collectively form a lower mating structure, the lower mating structure structurally configured to slidably engage with an outer surface of a valve body;

molding a central bellows having a first portion and a second portion, with the second portion forming the outer casing structure; and molding an upper mating structure at a first end of the first portion, the upper structure structurally configured to matingly engage with the outer surface of the valve body.

23. The method of claim 22 wherein the step of molding an outer encasing structure and the step of molding a central bellows and the step of molding an upper mating structure comprise a single step forming a single monolithic member having the outer casing structure, the central bellows and the upper mating structure.

24. The method of claim 22 wherein the inner ring member comprises a metal member, the first encasing structure comprises a silicone material and the outer encasing structure comprises a silicone material.

* * * * *